US006628056B2

(12) United States Patent
Ha

(10) Patent No.: US 6,628,056 B2
(45) Date of Patent: Sep. 30, 2003

(54) MASK ASSEMBLY FOR CATHODE RAY TUBE

(75) Inventor: Kuen-Dong Ha, Seongnam (KR)

(73) Assignee: Samsung SDI Co., Ltd., Suwon (KR)

( * ) Notice: Subject to any disclaimer, the term of this patent is extended or adjusted under 35 U.S.C. 154(b) by 14 days.

(21) Appl. No.: 10/079,901

(22) Filed: Feb. 22, 2002

(65) Prior Publication Data

US 2002/0180330 A1 Dec. 5, 2002

(30) Foreign Application Priority Data

Feb. 23, 2001 (KR) ..... 2001-9347

(51) Int. Cl.[7] ..... H01J 29/80
(52) U.S. Cl. ..... 313/402; 313/269; 313/402
(58) Field of Search ..... 313/402, 404, 313/407, 269

(56) References Cited

U.S. PATENT DOCUMENTS 3,638,063 A 1/1972 Tachikawa et al.
4,942,332 A 7/1990 Adler et al.
5,672,935 A * 9/1997 Ito et al. ..... 313/407

FOREIGN PATENT DOCUMENTS

JP 11-312476 11/1999

* cited by examiner

*Primary Examiner*—Vip Patel
(74) *Attorney, Agent, or Firm*—Staas & Halsey LLP

(57) ABSTRACT

A mask assembly for a cathode ray tube includes a tension mask having an effective portion formed with strips spaced apart from each other forming slots there between and a non-effective portion surrounding the effective portion. A mask frame includes a pair of supporting members along long sides of the tension mask and a pair of elastic members spacing the supporting members from each other by a predetermined distance. Vibration damping members damp vibration of the tension mask, where the vibration damping members are tensioned in a longitudinal direction to pressurize the non-effective portion.

20 Claims, 7 Drawing Sheets

MASK ASSEMBLY FOR CATHODE RAY TUBE

CROSS-REFERENCE TO RELATED APPLICATIONS

This application is based on application No. 2001-9347 filed with the Korea Patent Office on Feb. 23, 2001, the content of which is incorporated herein by reference.

BACKGROUND OF THE INVENTION

1. Field of the Invention

The present invention relates to a mask assembly for a cathode ray tube and, more particularly, to a mask assembly for a cathode ray tube which effectively prevents a display screen from manifesting a microphony phenomenon due to vibrations of a tension mask in a tube axis direction.

2. Description of the Related Art

Generally, a cathode ray tube is a display device where electron beams emitted from an electron gun strike phosphors on a phosphor screen to display desired picture images. A shadow mask is provided in the cathode ray tube as a color selection electrode to direct R, G, B electron beams from the electron gun to the corresponding R, G, B phosphors.

In a fabrication process of the shadow mask, a plurality of beam-guide apertures are first formed in a mask body, and then it is drawn. The shadow mask bears an extremely weak strength due to factors such as thinness, a large volume, and a large number of the beam-guide apertures. Hence, a so-called doming phenomenon occurs where the mask is thermally expanded toward the phosphor screen because of continual scanning of the electron beams.

When the shadow mask is deformed or suffers the doming phenomenon, the beam-guide apertures thereon are displaced from their correct positions, and do not perform a beam-guide operation, thereby deteriorating color purity. Therefore, in order to overcome the shortcomings of the conventional shadow mask and cope with screen flattening, a tension mask has been developed. The tension mask is mounted within the tube while bearing a tensional strength. U.S. Pat. No. 3,638,063 incorporated herein by reference, discusses an aperture grill-type tension mask. The mask is fitted to a frame such that strips thereon are spaced apart from each other by a predetermined distance while bearing a unidirectional tension.

In the above-structured shadow mask, the thermal expansion is absorbed by way of tensional strength obtained when mounting the strips. The strips are formed with a thin steel plate bearing a thickness of about 0.1–0.15 mm. The strips are not connected to each other, and only both ends of each strip are fitted to the frame. In this structure, each strip is independently vibrated even with sound impact from a speaker, and induces a display screen to manifest a microphony phenomenon while deteriorating the color purity.

U.S. Pat. No. 4,942,332 incorporated herein by reference, discusses a mask where a plurality of strips are spaced apart from each other while forming slots between them, with real bridges interconnecting the strips. Long sides of the mask are fitted to supporting members. In the mask, the real bridges interconnecting the strips can reduce the microphony phenomenon to some degree.

Furthermore, Japanese Patent Publication Laid-Open No. Hei11-312476, incorporated herein by reference discusses a tension mask fitted to a frame that is arc-shaped with a predetermined curvature corresponding to a shape of a panel. Damper wires with a very small diameter of 10–20 $\mu$m are fitted to the tension mask with a predetermined tensional strength. The damper wires contact the mask while proceeding perpendicular to the beam-guide apertures. The damper wires can also reduce the microphony phenomenon to some degree.

However, in the tension mask with damper wires, a non-effective portion at short sides of the mask is rotated toward the panel due to the tensional strength of the damper wires. Consequently, the damper wires do not contact the tension mask in an appropriate manner, so that the damper wires cannot effectively prevent the microphony phenomenon.

The damper wires may have a sufficient strength for controlling the vibration of the strips, but in a case of the tension mask with real bridges and damper wires, as the mask exhibits face vibrations due to the real bridges, the damper wires alone cannot effectively compensate for such face vibrations. Furthermore, a screen bears lines due to the shadowing of the damper wires.

SUMMARY OF THE INVENTION

Various objects and advantages of the invention will be set forth in part in the description that follows and, in part, will be obvious from the description, or may be learned by practice of the invention.

It is an object of the present invention to provide a mask assembly for a cathode ray tube that effectively prevents a display screen from suffering a microphony phenomenon due to external impacts.

This and other objects may be achieved by a mask assembly for a cathode ray tube with the following features. The mask assembly includes a shadow mask, a mask frame, and vibration damping members. The shadow mask has a rectangular-shaped effective portion with a plurality of beam-guide holes, and a non-effective portion surrounding the effective portion. The mask frame has a pair of supporting members along long sides of the shadow mask, and a pair of elastic members spacing the supporting members from each other by a predetermined distance. The shadow mask is supported by the mask frame during a tensioned state. The vibration damping members dampen the vibration of the shadow mask in a tube axis direction. The vibration damping members are tensioned in a longitudinal direction such that the vibration damping members pressurize the non-effective portion standing with the long sides of the shadow mask against the mask frame.

The effective portion has a plurality of strips spaced apart from each other by a predetermined distance while forming slots to be used as the beam-guide holes, with real bridges interconnecting neighboring strips, and a plurality of dummy bridges provided within each slot without interconnecting the neighboring strips.

The vibration damping members are a pair of damper strips. Each damper strip has a variable width or thickness in the longitudinal direction, and end portions of each damper strip are fixed to fixtures internally provided at the lateral sides of the supporting members, or directly to the lateral sides of the supporting members. Wedges are partially inserted between the non-effective portion and the damper strips.

Alternatively, the vibration damping members may be a pair of coil springs. In this case, a pressurizing force of each coil spring is distributed by differentiating a diameter of the center of the coil spring from a diameter of an end portion of the coil spring.

These together with other objects and advantages, which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

The above and other objects and advantages of the present invention will become more apparent by describing in detail preferred embodiments thereof with reference to the attached drawings in which.

DETAILED DESCRIPTION OF THE PREFERRED EMBODIMENTS

Hereinafter, embodiments of the present invention will be described in detail with reference to the attached drawings.

Figure 1:
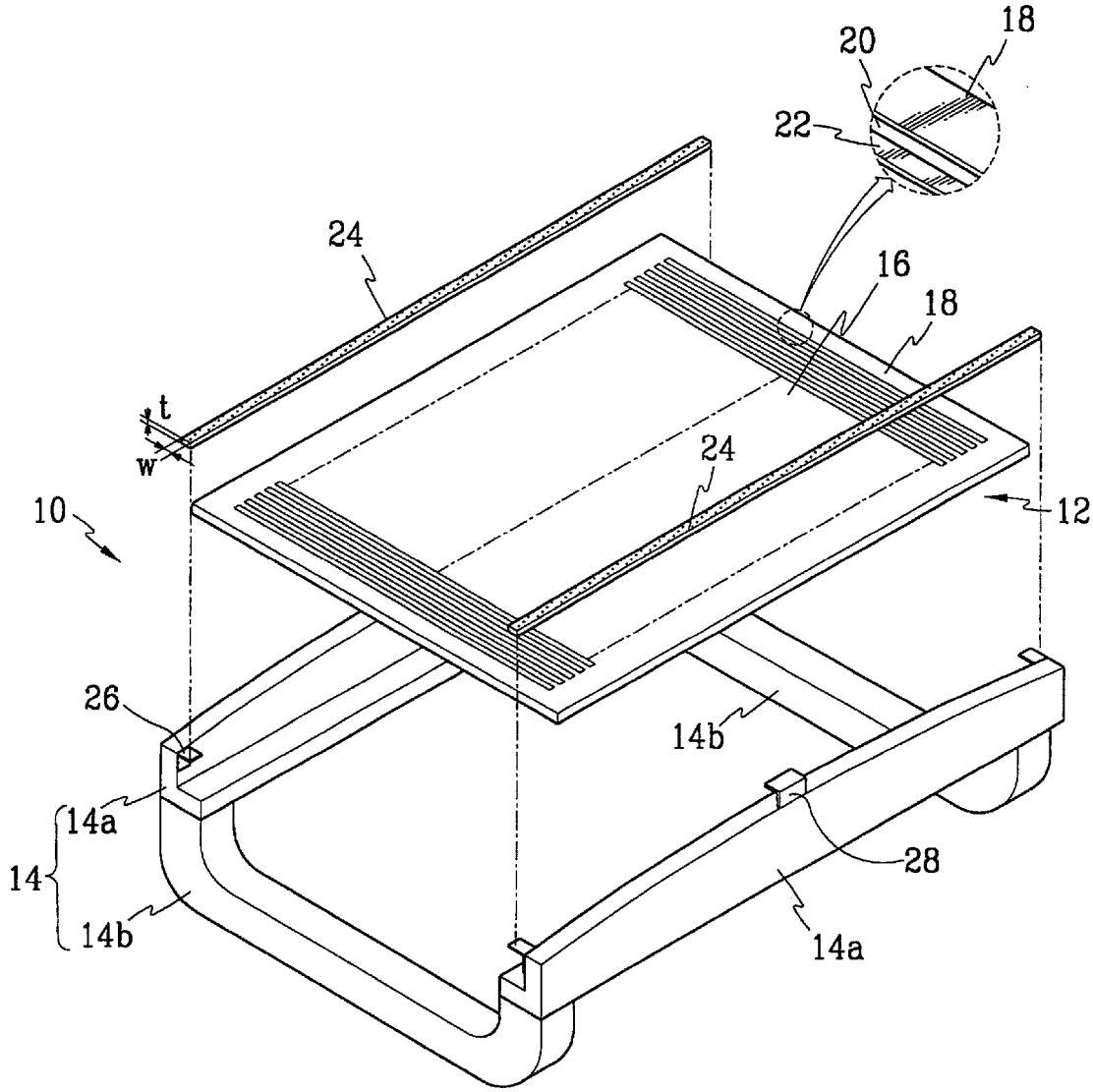
FIG. 1 is an exploded perspective view of a mask assembly for a cathode ray tube according to an embodiment of the present invention.
Figure 2:
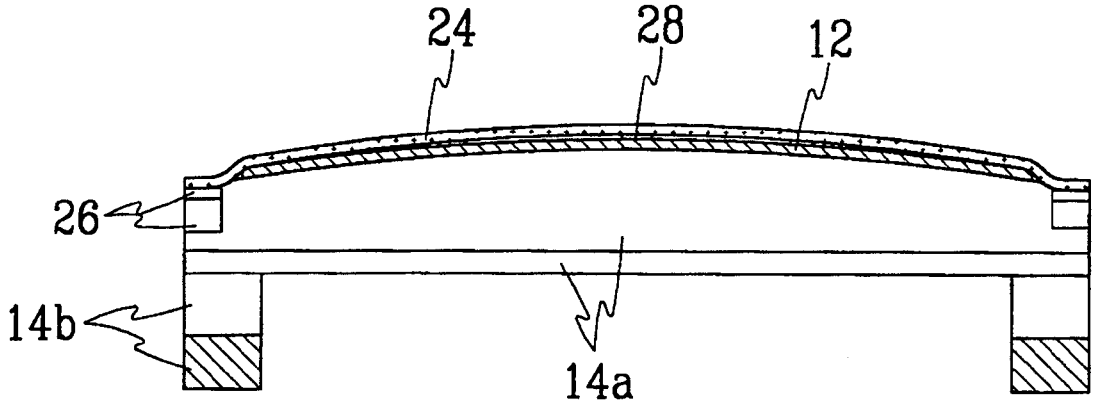
FIG. 2 illustrates the mask assembly shown in FIG. 1 assembled.
Figure 3:
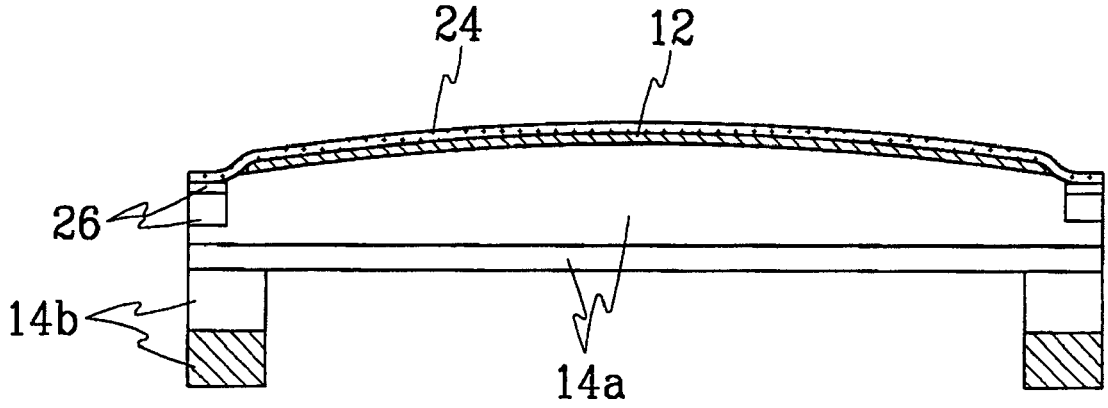
FIG. 3 illustrates the mask assembly show in FIG. 1 assembled where a wedge is removed.

FIG. 1 is an exploded perspective view of a mask assembly according to an embodiment of the present invention, FIG. 2 illustrates the mask assembly shown in FIG. 1 assembled, and FIG. 3 illustrates the mask assembly shown in FIG. 1 where a wedge is removed.

A mask assembly 10 mounted within a faceplate of a panel while being spaced apart from a phosphor screen has a tension mask 12 functioning as a color selection electrode, a mask frame 14 supporting the tension mask 12, and a plurality of springs fixing the mask frame 14 to the panel.

The tension mask 12 has a rectangular-shaped effective portion 16, and a non-effective portion 18 surrounding the effective portion 16. The effective portion 16 is formed with a plurality of strips 22, and slots 20 are disposed between the strips 22. R, G, B electron beams emitted from R, G, B electron guns pass through the slots 20 such that the R, G, B electron beams land on corresponding R, G, B phosphors of the phosphor screen.

The tension mask 12 is fitted to the mask frame 14 while being tensioned in at least one direction. The tensioning is mainly made along long sides of the tension mask 12. The mask frame 14 is formed with a pair of supporting members 14*a* facing the long sides of the tension mask 12, and a pair of elastic members 14*b* spacing the supporting members 14*a* from each other by a predetermined distance.

The supporting members 14*a* are arc-shaped with a predetermined curvature such that the shape thereof corresponds to that of the faceplate of the panel. The supporting members 14*a* are longitudinally extended over the long sides of the tension mask 12.

The mask assembly has vibration damping members for damping vibration energy from the outside. In this embodiment, the vibration damping members are formed as a pair of damper strips 24 bearing a relatively large width or thickness compared to a conventional damper wire. For instance, the damper strips 24 may have a width of 3–15 mm, and a thickness of 0.1–1.0 mm. The damper strips 24 have a length larger than the long side of the tension mask 12, or similar to the supporting members 14*a*. The damper strips 24 are provided at the non-effective portion 18 along the long sides of the tension mask 12. Namely, a tensioning direction of the damper strips 24 is perpendicular to a tensioning direction of the shadow mask.

Figure 4:
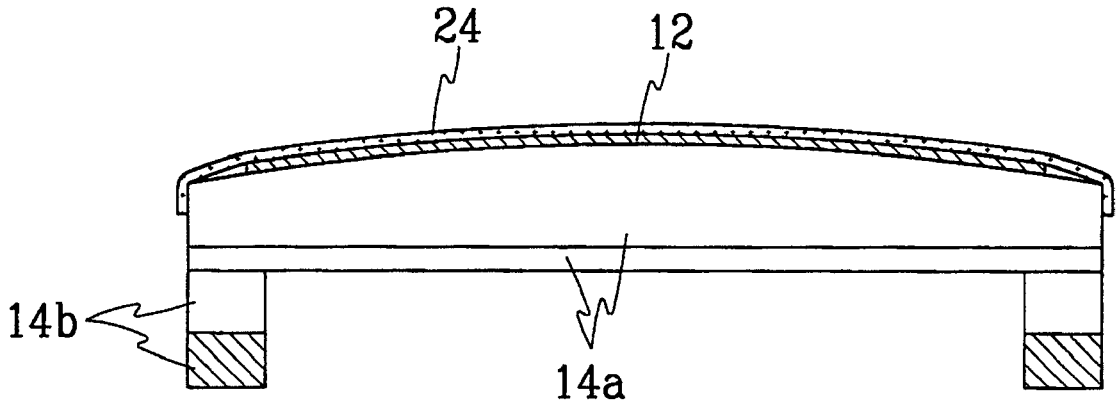
FIG. 4 illustrates an alternative embodiment of the mask assembly show in FIG. 1 where the wedge is removed.

As shown in FIGS. 1 to 3, the damper strips 24 are fixed to L-shaped fixtures 26 internally fitted to the supporting members 14*a*. Alternatively, the damper strips 24 may be directly fixed to lateral sides of the supporting members 14*a* (as shown in FIG. 4). Portions of the fixtures 26 contacting ends of the damper strips 24 are placed 0.1–2 mm below the tension mask 12.

The damper strips 24 are first placed on the non-effective portion 18 along the long sides of the tension mask 12, and opposite end portions of the damper strips 24 are welded to the fixtures 26 on one end of the tension mask 12. The opposite end portions of the damper strips 24 are then welded to the fixtures 26 on another opposite end of the tension mask 12 while being tensioned in a longitudinal direction.

Consequently, the non-effective portion 18 of the tension mask 12 along the long sides thereof is pressurized by way of the damper strips 24 with a predetermined pressure. Accordingly, when the mask 12 is vibrated in a tube axis direction due to external vibration energy, an amplitude of vibration of the mask 12 is reduced, and the vibration energy of the mask 12 is exhausted as a friction energy with respect to the damper strips 24.

In the above-structured mask assembly, when it is required to make a localized increase in a pressurizing force, as shown in FIGS. 1 and 2, L-shaped wedges 28 are welded to the supporting members 14*a* such that free end portions of the supporting members 14*a* are disposed between the non-effective portion 18 and the damper strips 24.

When the part of the wedge 28 is placed under a center of the long side of the damper strip 24, side portions of the damper strip 24 contact the mask 12 in the tube axis direction with increased contact force while reducing an amplitude of vibration at the contact points. In case the wedge 28 is placed under respective end portions of the long side of the damper strip 24, the pressurizing force is enhanced at the center of the damper strip 24. In addition, the pressurizing force of the damper strip 24 can be distributed in a controlled manner by varying a width, w, or a thickness, t, of the damper strip 24 in the longitudinal direction.

Figure 5:
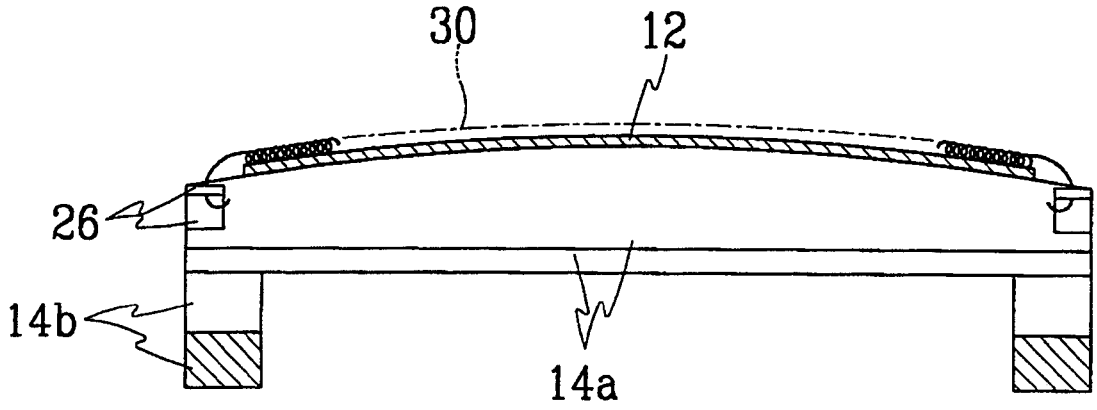
FIG. 5 illustrates an alternative embodiment of the mask assembly shown in FIG. 1 where a vibration-damping member has an alternative structure.

FIG. 5 illustrates vibration damping members having an alternative structure. The vibration damping members are formed with coil springs 30. Each coil spring 30 is fixed to the fixtures 26 while being tensioned in the longitudinal direction. For that purpose, the fixture 26 bears a hole receiving an end of the coil spring 30. The hole of the fixture 26 is positioned below the tension mask 12.

The pressurizing force of the coil spring 30 can be distributed by controlling the tensional strength thereof, making a central diameter of the coil spring 30 to be larger than that of an ending diameter, or gradually reducing the diameter of the coil spring 30 from a center thereof.

Figure 6:
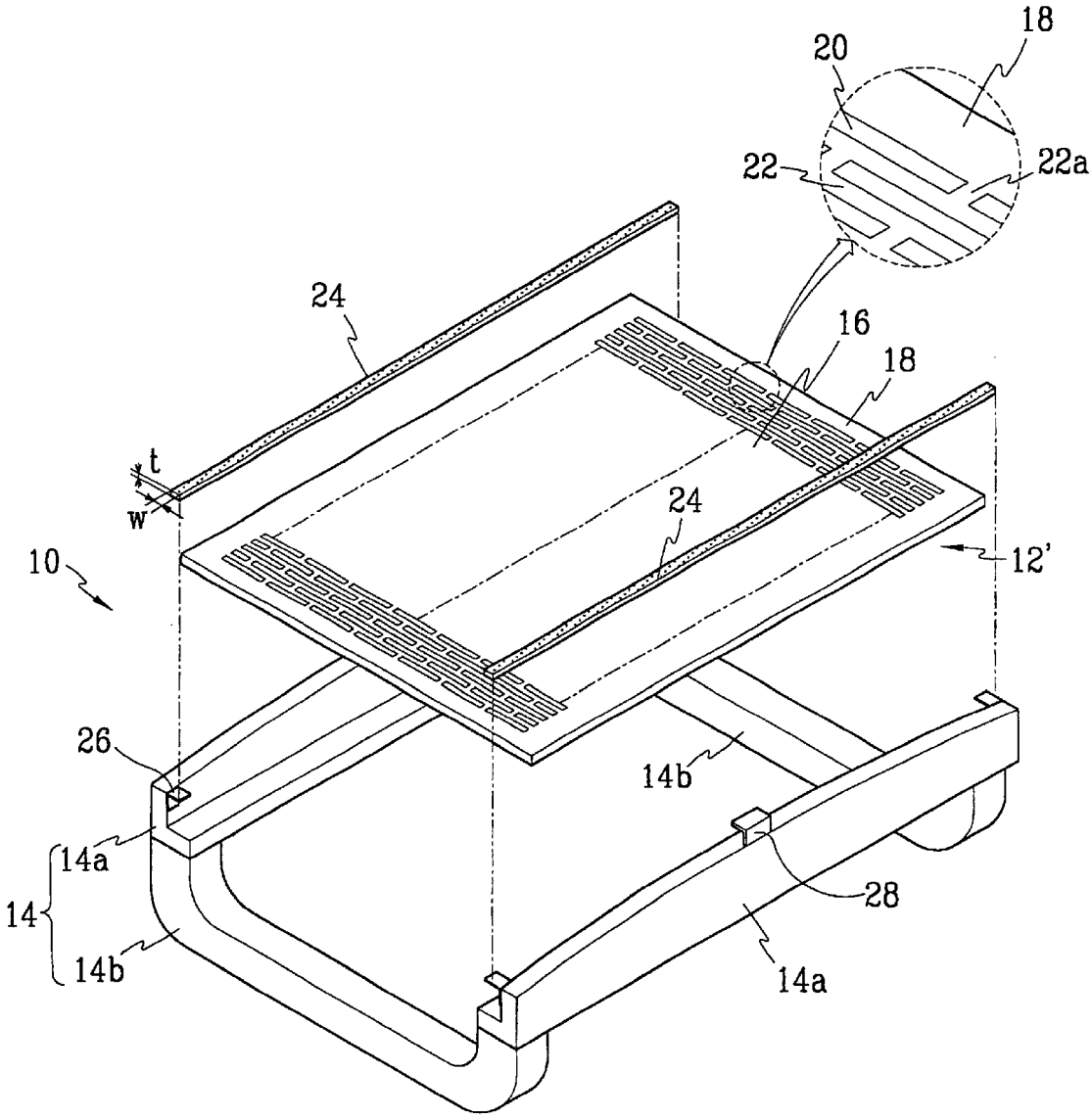
FIG. 6 is an exploded perspective view of a mask assembly for the cathode ray tube according to an alternative embodiment of the present invention.
Figure 7:
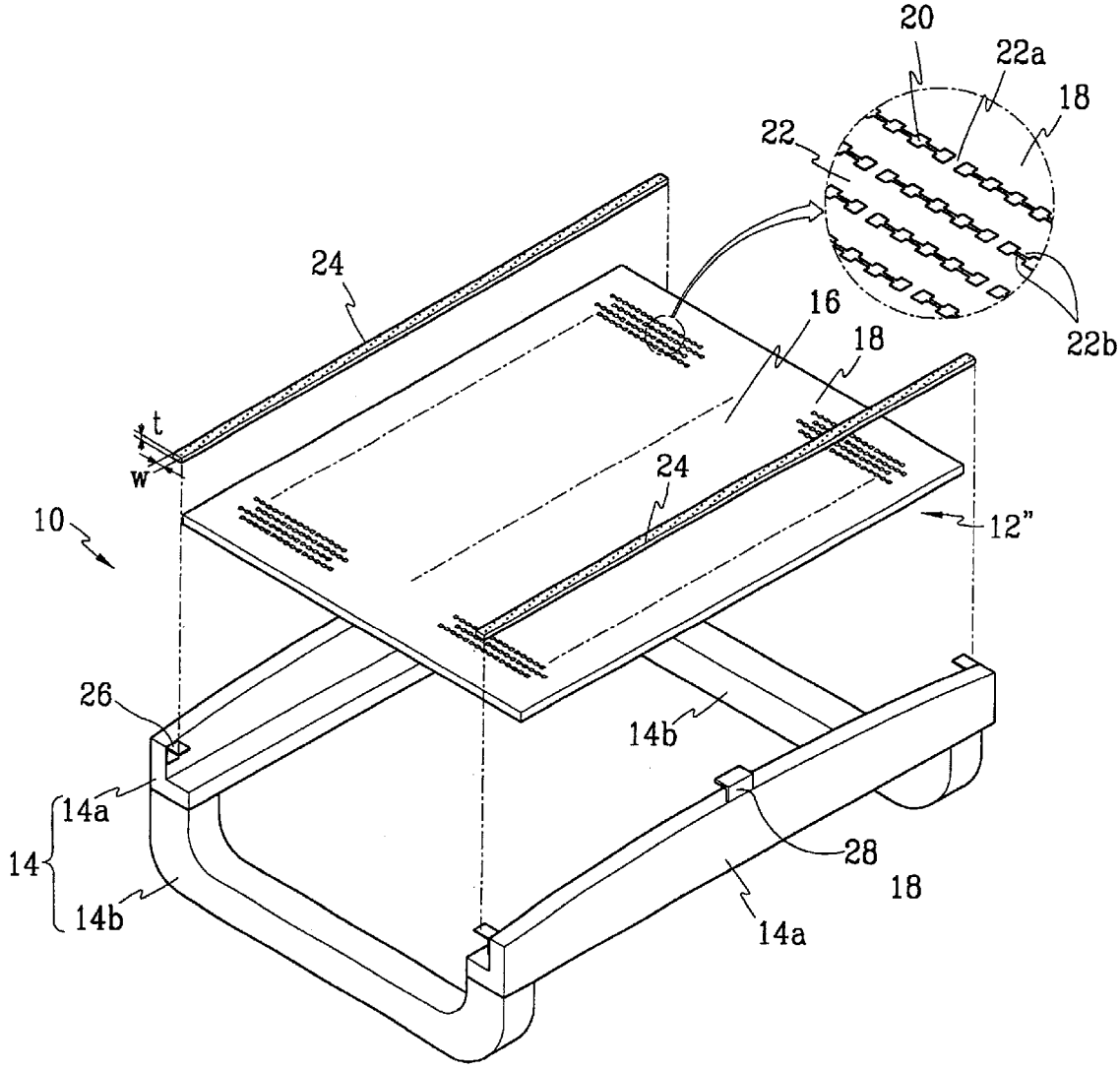
FIG. 7 is an exploded perspective view of a mask assembly for the cathode ray tube according to an alternative embodiment of the present invention.

FIGS. 6 and 7 are exploded perspective views of mask assemblies according to second and third embodiments of the present invention, respectively. In these embodiments, some components and structures of the mask assembly are the same as those related to the first embodiment, except for components of the tension mask 12. Therefore, only the structure of the tension mask 12 will be now described in detail. As shown in FIG. 6, the effective portion 16 of the tension mask 12' is formed with a plurality of strips 22 spaced apart from each other by a predetermined distance while forming slots 20 between them, with real bridges 22*a* interconnecting the neighboring strips 22.

As shown in FIG. 7, the effective portion 16 of the tension mask 12" is formed with a plurality of strips 22 spaced apart from each other by a predetermined distance while forming slots 20 between them. Real bridges 22*a* interconnect the neighboring strips 22 and a plurality of dummy bridges 22*b* are provided at each slot 20 not interconnecting the neighboring strips 22.

When a vibration frequency is transmitted to the vibration damping members, such as the damper strips 24 or the coil springs 30, the vibration damping members 24 or 30 function as a damper to compensate for the vibration, or change a vibration mode while reducing a duration thereof. Accordingly, the mask assembly 10 reduces an amplitude of vibration from a speaker by way of the vibration damping members 24 or 30, thereby preventing possible errors in landing of the electron beams on the corresponding phosphors, and deterioration of the color purity.

Repeated experiments have shown that an amplitude of vibration with the inventive mask assembly could be reduced by 20–40% compared to the conventional mask assembly. Furthermore, it has been confirmed through experiments that an average vibration-damping duration using the conventional mask assembly was about 4 seconds or more, but the vibration-damping duration with the mask assembly according to the present invention was about 1.5–2.2 seconds.

The pressurizing force of the mask can be distributed in a controlled manner by varying the width or thickness of the damper strip, or varying the diameter of the coil spring. As described above, the mask assembly according to the present invention bears increased tension by way of the vibration damping members 24 or 30 fitted to the non-effective portion along the long sides of the tension mask 12.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A mask assembly for a cathode ray tube, comprising:

a shadow mask comprising an effective portion with beam-guide apertures and a non-effective portion surrounding the effective portion;

a mask frame comprising a pair of supporting members along long sides of the shadow mask and a pair of elastic members spacing the supporting members from each other by a predetermined distance, the shadow mask being supported by the mask frame during a tensioned state; and vibration damping members damping vibration of the shadow mask, wherein the vibration damping members are tensioned in a longitudinal direction to pressurize the non-effective portion along the long sides of the shadow mask against the mask frame.

2. The mask assembly as recited in claim 1, wherein the effective portion comprises strips spaced apart from each other by a predetermined distance to form slots used as beam-guide apertures.

3. The mask assembly as recited in claim 1, wherein the vibration damping members are a pair of damper strips.

4. The mask assembly as recited in claim 3, wherein each damper strip comprises a variable width or thickness in the longitudinal direction.

5. The mask assembly as recited in claim 3, further comprising:

fixtures internally provided at lateral sides of the supporting members, wherein end portions of each damper strip are fixed to the fixtures.

6. The mask assembly as recited in claim 3, wherein end portions of each damper strip are fixed to lateral sides of the supporting members.

7. The mask assembly as recited in claim 3, further comprising wedges partially inserted between the non-effective portion and the damper strips.

8. The mask assembly as recited in claim 2, wherein the vibration damping members are a pair of coil springs.

9. The mask assembly as recited in claim 8, wherein a pressurizing force of each coil spring is distributed by differentiating a diameter of a center of the coil spring from a diameter of an end portion of the coil spring.

10. A mask assembly for a cathode ray tube, comprising:

a shadow mask comprising an effective portion with beam-guide apertures and a non-effective portion surrounding the effective portion, the effective portion comprising strips spaced apart from each other by a predetermined distance to form slots used as beam-guide apertures and real bridges interconnecting neighboring strips;

a mask frame comprising a pair of supporting members along long sides of the shadow mask and a pair of elastic members spacing the supporting members from each other by a predetermined distance, the shadow mask being supported by the mask frame during a tensioned state; and vibration damping members damping vibration of the shadow mask, wherein the vibration damping members are tensioned perpendicular to a tensioning direction of the shadow mask to pressurize the non-effective portion along the long sides of the shadow mask against the mask frame.

11. The mask assembly as recited in claim 10, wherein the vibration damping members are a pair of damper strips.

12. The mask assembly as recited in claim 11, wherein each damper strip comprises a variable width or thickness in the longitudinal direction.

13. The mask assembly as recited in claim 11, further comprising wedges partially inserted between the non-effective portion and the damper strips.

14. The mask assembly as recited in claim 10, wherein the vibration damping members are a pair of coil springs.

15. The mask assembly as recited in claim 14, wherein pressurizing force of each coil spring is distributed by differentiating a diameter of a center of the coil spring from a diameter of an end portion of the coil spring.

16. The mask assembly as recited in claim 10, wherein the effective portion further comprises:

dummy bridges within each slot not interconnecting the neighboring strips.

17. A mask assembly for a cathode ray tube, comprising:

a tension mask comprising an effective portion formed with strips spaced apart from each other forming slots therebetween and a non-effective portion surrounding the effective portion;

a mask frame comprising a pair of supporting members along long sides of the tension mask and a pair of elastic members spacing the supporting members from each other by a predetermined distance; and vibration damping members damping vibration of the tension mask, wherein the vibration damping members are tensioned in a longitudinal direction to pressurize the non-effective portion.

18. The mask assembly as recited in claim 17, wherein the vibration damping members pressurize the non-effective portion along the long sides of the shadow mask against the mask frame.

19. The mask assembly as recited in claim 17, further comprising fixtures internally provided at lateral sides of the supporting members, wherein the vibration damping members are a pair of damper strips, each damper strip comprising a variable width or thickness in the longitudinal direction, and end portions of each damper strip are fixed to lateral sides of the supporting members.

20. The mask assembly as recited in claim 17, wherein the vibration damping members are a pair of coil springs, where a pressurizing force of each coil spring is distributed by differentiating a diameter of a center of the coil spring from a diameter of an end portion of the coil spring.

* * * * *